US009701030B1

(12) United States Patent
Hodges

(10) Patent No.: US 9,701,030 B1
(45) Date of Patent: Jul. 11, 2017

(54) KITCHEN UTENSIL

(71) Applicant: Paul Brendan Hodges, Largo, FL (US)

(72) Inventor: Paul Brendan Hodges, Largo, FL (US)

(73) Assignee: Paul B Hodges, Largo, FL (US)

( * ) Notice: Subject to any disclaimer, the term of this patent is extended or adjusted under 35 U.S.C. 154(b) by 19 days.

(21) Appl. No.: 14/726,364

(22) Filed: May 29, 2015

(51) Int. Cl.
*B26B 3/04* (2006.01)
*B26B 29/06* (2006.01)
*B26F 1/32* (2006.01)

(52) U.S. Cl.
CPC ..... *B26B 3/04* (2013.01); *B26B 29/063* (2013.01); *B26F 1/32* (2013.01)

(58) Field of Classification Search
CPC ... B26B 3/04; B26B 29/093; B26B 2029/066; B26F 1/32
USPC .... 30/305, 314, 315, 357; D7/649, 693, 696
See application file for complete search history.

(56) References Cited

U.S. PATENT DOCUMENTS 4,574,479 A * 3/1986 Gramann ..... A47G 21/045 294/7
4,959,905 A * 10/1990 Ghislain ..... B26B 29/025 30/151
D352,426 S * 11/1994 Tucker ..... D32/46
5,920,992 A * 7/1999 Watermolen ..... B26B 3/00 30/114
D500,644 S * 1/2005 Cavanaugh ..... D32/49
D662,787 S * 7/2012 Holmes ..... D7/401.2
8,752,298 B2 * 6/2014 Collins ..... B26B 1/044 30/160
2005/0217117 A1 * 10/2005 Willis ..... A21C 11/106 30/114
2009/0144987 A1 * 6/2009 Mills ..... B26B 3/04 30/173
2010/0180452 A1 * 7/2010 Mucci ..... B26B 9/02 30/314
2015/0197025 A1 * 7/2015 Spae ..... B26B 3/04 30/114

* cited by examiner

*Primary Examiner* — Hwei C Payer

(57) ABSTRACT

The kitchen utensil provides the consumer a unique method for cutting a sandwich, which includes perforating or a complete and clean cut. The kitchen utensil while upright with the top portion resting in the palm of the consumer's hand with downward pressure being applied and rocked from end to end will push the bottom portion made up of the kitchen utensil blade or cutting side consisting of both comb like teeth in the center and wide blades on either end through the sandwich. The sandwich after being perforated will maintain its traditional square or rectangular shape so the consumer can place and remove the sandwich in and out of a sandwich bag.

1 Claim, 3 Drawing Sheets

KITCHEN UTENSIL

CROSS-REFERENCE TO RELATED APPLICATIONS

Application Number has been added to the Application Data Sheet

STATEMENT REGARDING FEDERALLY SPONSORED RESEARCH OR DEVELOPMENT

Not Applicable

REFERENCE TO A SEQUENCE LISTING IF APPLICABLE

Not Applicable

BACKGROUND OF THE INVENTION

When using a standard kitchen knife to cut a sandwich, that same sandwich then becomes two or more parts, thus becoming awkward to place in a standard plastic sandwich bag for transport and removal while still maintaining the integrity of an uncut sandwich once it reaches its final destination for consumption.

Presently, there is no solution for cutting and maintaining the integrity of the original sandwich square shape.

BRIEF SUMMARY OF THE INVENTION

This kitchen utensil seeks to address the problem described above by introducing a device that incorporates both a cutting and perforating edge/blade that, when operated in a rocking motion, in a single direction, front to back or back to front, creates the specified utility function.

BRIEF DESCRIPTION OF DRAWINGS

The kitchen utensil described herein is illustrated with reference to the various drawings, in which like reference numbers denote like device components and/or method steps, respectively, and in which.

DETAILED DESCRIPTION OF THE INVENTION

Figure 1:
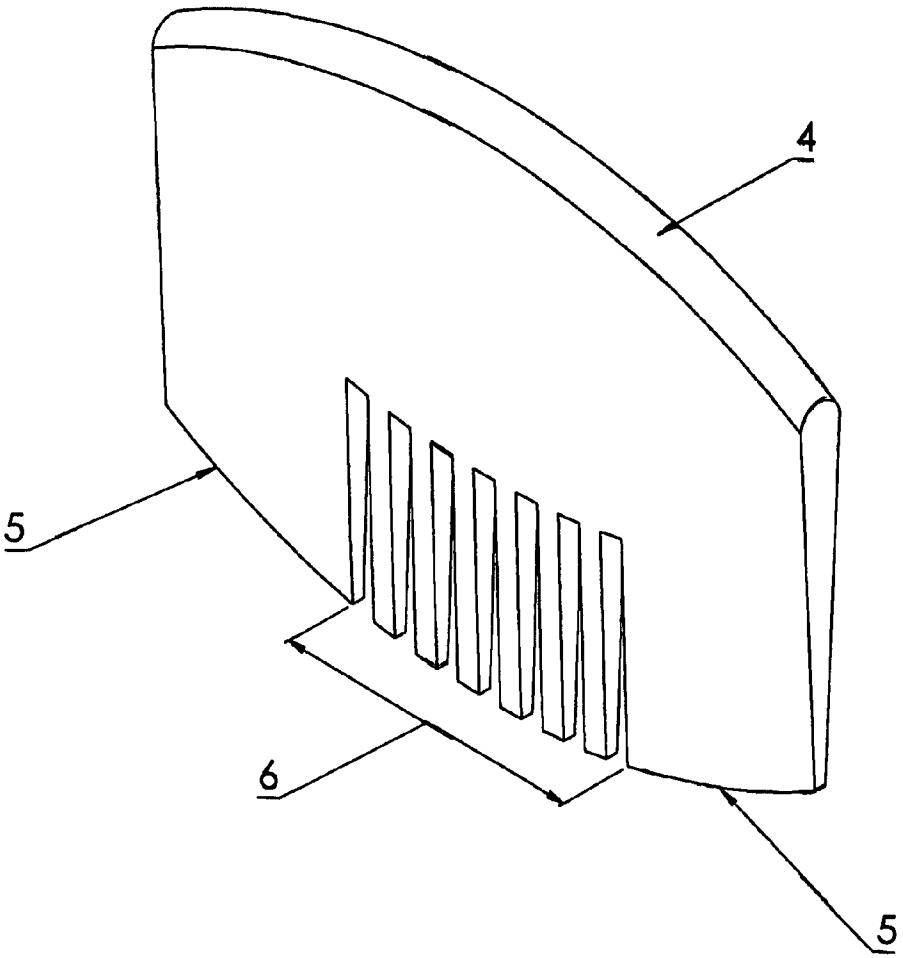
FIG. 1 is an isometric view of the kitchen utensil.

Reference is made herein to the attached drawings. Like reference numerals are used throughout the drawings to depict like or similar elements of the handheld, kitchen utensil device. For the purposes of presenting a brief and clear description of the present invention, the preferred embodiment will be discussed as used for aiding the user in the functionality of this kitchen utensil, manually. The figures are intended for representative purposes only and should not be considered to be limiting in any respect.

Figure 2:
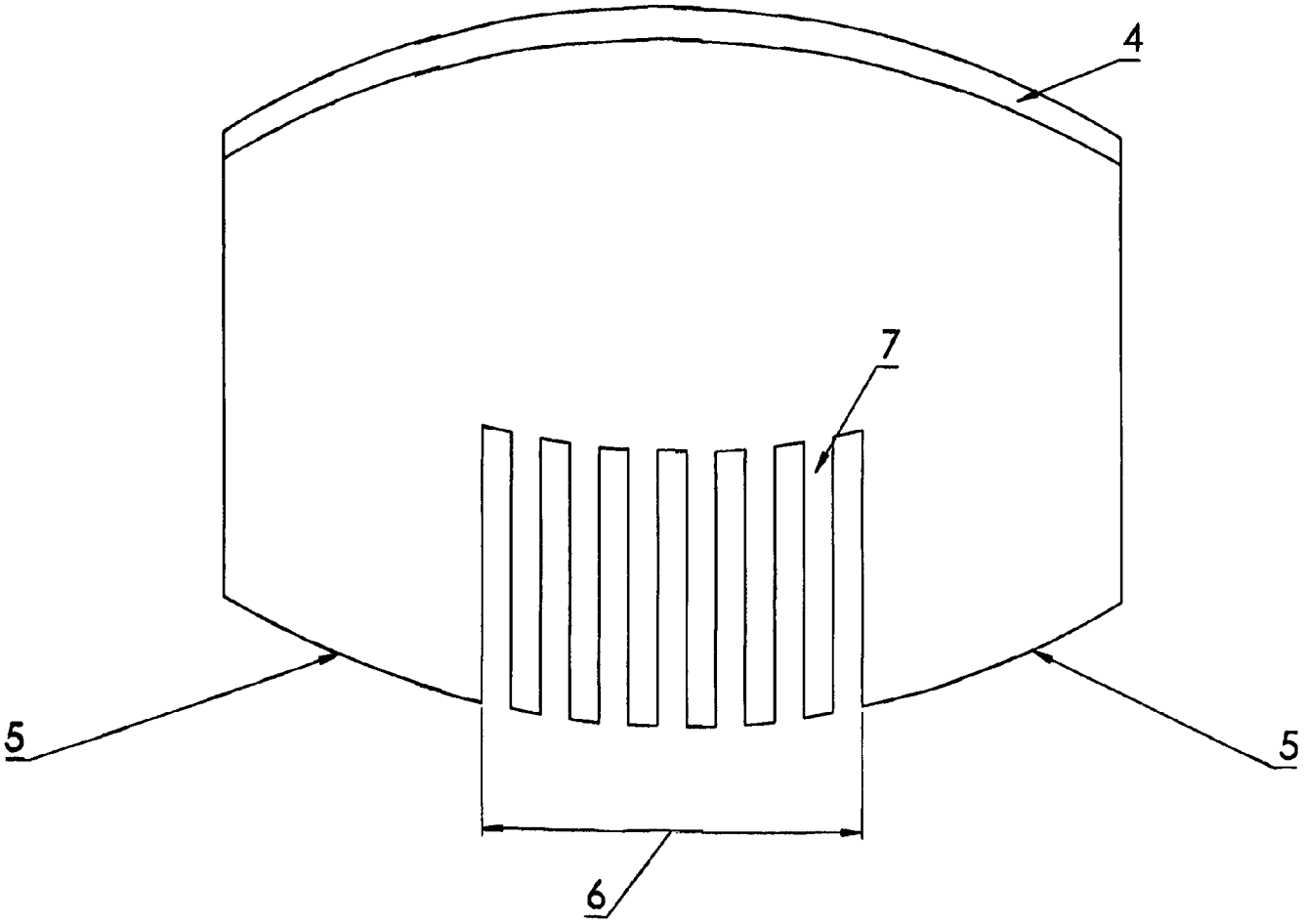
FIG. 2 depicts both a front view of the kitchen utensil.
Figure 3:
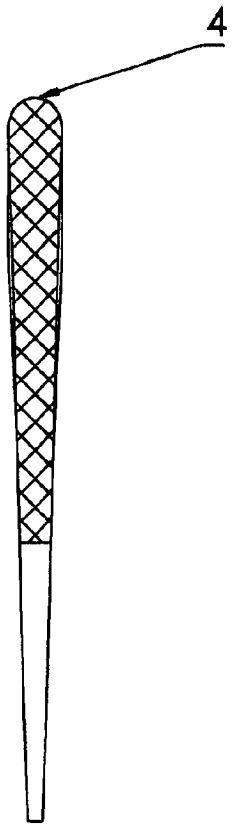
FIG. 3 is a cross section view of the kitchen utensil.

When cutting a sandwich, which typically consists of two pieces of bread, one on the bottom and one on the top, with the consumers desired ingredients, which may include a combination of ingredients, this kitchen utensil, while being held or cradled in the palm of the user's hand, on the rounded edge 4 of the top of the utensil, depicted in FIG. 1, FIG. 2 and FIG. 3, extending from the base of the palm to the tip of the index finger, in either hand and while applying down pressure onto the palm, will cut 5 and perforate 6 through the aforementioned bread and other ingredients. The user will, while resting their palm on the rounded top edge 4 of the kitchen utensil, in a rocking motion from the base of the palm of the hand to the tip of the index finger, or in reverse, rock the kitchen utensil from one end through the middle to the opposite end cutting 5 the crust on one end, perforating 6 the center of the sandwich and again cutting 5 the crust on the opposite end. The center portion of the utensil consists of a plurality of combed cutting implements 7 that perforate the center of the sandwich while again maintaining the integrity of the sandwiches original square shape.

FIG. 2 shows a kitchen utensil comprising a body having a rounded convex-shaped upper edge (4) adapted to be held by a user and an opposing convex-shaped lower cutting edge suitable for cutting. The convex-shaped lower cutting edge comprises a first side cutting section (5), a second side cutting section (5) and a middle perforating cutting section (6). The middle perforating cutting section (6) spans between the side cutting sections (5). The body further comprises a plurality of spaced apart teeth as seen in FIG. 2. Each of said teeth extends vertically from the middle perforating cutting section (6) toward the rounded convex-shaped upper edge (4). As clearly shown in FIG. 2, the span of the middle perforating cutting section is smaller than the sum of the length of the first side cutting section and the length of the second side cutting section but is greater than the length of each of the first side cutting section and the second side cutting section.

The invention claimed is:

1. A kitchen utensil for cutting and perforating food products comprising:

a body comprising a rounded convex-shaped upper edge adapted to be held by a user and an opposing convex-shaped lower cutting edge suitable for cutting and perforating the food products;

said convex-shaped lower cutting edge comprising a first side cutting section, a second side cutting section and a middle perforating cutting section, wherein the middle perforating cutting section spans between the side cutting sections;

said body further comprising a plurality of spaced apart teeth, each of said teeth extending vertically from the middle perforating cutting section toward the rounded convex-shaped upper edge; and wherein the span of the middle perforating cutting section is smaller than the sum of the length of the first side cutting section and the length of the second side cutting section but is greater than the length of each of the first side cutting section and the second side cutting section.

* * * * *